US010935300B2

(12) United States Patent
Takase et al.

(10) Patent No.: US 10,935,300 B2
(45) Date of Patent: Mar. 2, 2021

(54) REFRIGERATOR INCLUDING A DETACHABLY MOUNTED COOLING UNIT

(71) Applicant: Samsung Electronics Co., Ltd, Suwon-si (KR)

(72) Inventors: Hitoshi Takase, Kanagawa (JP); Shingo Imano, Kanagawa (JP); Tomoharu Iwamoto, Kanagawa (JP); Tomohiko Matsuno, Kanagawa (JP); Makoto Shibuya, Kanagawa (JP); Tatsuya Seo, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 73 days.

(21) Appl. No.: 16/178,508

(22) Filed: Nov. 1, 2018

(65) Prior Publication Data

US 2019/0128586 A1 May 2, 2019

(30) Foreign Application Priority Data

Nov. 1, 2017 (JP) ..... 2017-212002
Sep. 14, 2018 (KR) ..... 10-2018-0110166

(51) Int. Cl.
*F25D 11/02* (2006.01)
*F25B 13/00* (2006.01)
(Continued)

(52) U.S. Cl.
CPC ..... *F25D 11/02* (2013.01); *F25B 13/00* (2013.01); *F25D 17/065* (2013.01); *F25D 19/00* (2013.01); *F25B 1/10* (2013.01)

(58) Field of Classification Search
CPC ..... F25D 11/02; F25D 19/00; F25D 17/065; F25D 23/006; F25B 13/00; F25B 1/00
USPC ..... 62/298
See application file for complete search history.

(56) References Cited

U.S. PATENT DOCUMENTS 5,417,079 A * 5/1995 Rudick ..... F25D 17/062 62/253
7,231,782 B2 6/2007 Jung
(Continued)

FOREIGN PATENT DOCUMENTS

FR 2855871 A1 12/2004
JP 2005291523 A 10/2005
(Continued)

OTHER PUBLICATIONS

International Search Report dated Feb. 26, 2019 in connection with International Patent Application No. PCT/KR2018/013136, 3 pages.
(Continued)

*Primary Examiner* — Steve S Tanenbaum

(57) ABSTRACT

Disclosed is a refrigerator that facilitates access to each evaporator and improves maintenance performance. In the refrigerator, a different temperature of cold air cooled by each evaporator is brought into each cooling chamber with a different temperature range and different humidity range. The refrigerator includes a main refrigerator body including a machine room and a cooling chamber, an evaporator contained in the machine room, and a cooling unit detachably mounted in the machine room and including a compressor, a condenser, and an insulation member, wherein the cooling unit, while mounted in the machine room, has the insulation member tightly contact an inner wall of the machine room to form an insulation space, and the evaporator is contained in the insulation space.

19 Claims, 17 Drawing Sheets

(51) Int. Cl.

| | |
|---|---|
| ***F25D 17/06*** | (2006.01) |
| ***F25D 19/00*** | (2006.01) |
| ***F25B 1/00*** | (2006.01) |
| *F25B 1/10* | (2006.01) |

(56) References Cited

U.S. PATENT DOCUMENTS

| | | | | |
|---|---|---|---|---|
| 7,430,876 | B2 * | 10/2008 | Iguchi | F25D 19/02 62/255 |
| 2006/0130518 | A1 | 6/2006 | Kang et al. | |
| 2015/0272345 | A1 | 10/2015 | Bhatia et al. | |
| 2016/0153694 | A1 | 6/2016 | Ko et al. | |

FOREIGN PATENT DOCUMENTS

| | | | | |
|---|---|---|---|---|
| JP | 2015-014434 | A | | 1/2015 |
| KR | 1998-014956 | U | | 6/1998 |
| KR | 10-2003-0027367 | A | | 4/2003 |
| KR | 20030027367 | A | * | 4/2003 |
| KR | 10-0538170 | B1 | | 12/2005 |
| KR | 10-2007-0022047 | A | | 2/2007 |
| KR | 10-0725790 | B1 | | 6/2007 |
| KR | 10-2016-0065593 | A | | 6/2016 |
| WO | 2008/063184 | A1 | | 5/2008 |

OTHER PUBLICATIONS

Written Opinion of the International Searching Authority dated Feb. 26, 2019 in connection with International Patent Application No. PCT/KR2018/013136, 8 pages.

Supplementary European Search Report dated Oct. 13, 2020 in connection with European Patent Application No. 18 87 2439, 7 pages.

* cited by examiner

REFRIGERATOR INCLUDING A DETACHABLY MOUNTED COOLING UNIT

CROSS-REFERENCE TO RELATED APPLICATIONS

This application is based on and claims priority under 35 U.S.C. § 119 to Japanese Patent Application No. 2017-212002 filed on Nov. 1, 2017 in the Japanese Intellectual Property Office and Korean Patent Application No. 10-2018-0110166 filed on Sep. 14, 2018 in the Korean Intellectual Property Office, the disclosures of which are incorporated herein by reference in their entirety.

BACKGROUND

1. Field

The present disclosure relates to a refrigerator.

2. Description of Related Art

A traditional refrigerator is, for example, a refrigerator having an insulated room enclosed by an insulation material located near a machine room installed in an upper portion of the main refrigerator body and having an evaporator for freezing and an evaporator for refrigeration contained in parallel in the insulation room.

However, since the insulation room has a box-like body enclosed by the insulation material, in order to check whether the evaporators contained in the insulation room have an error, the box-like body needs to be detached from the upper portion of the main refrigerator body, opened, and once opened, sealed again, so the process of checking the evaporators is very troublesome.

Furthermore, since the evaporator for freezing and the evaporator for refrigeration are contained in a single insulation room, relatively-low temperature cold air passing the evaporator for freezing and relatively-high temperature cold air passing the evaporator for refrigeration are mixed in the insulation room. This may cause a problem in that the freezer chamber specially requiring low temperature cooling by means of the evaporator for freezing cannot be efficiently cooled.

SUMMARY

A main objective of the present disclosure is to provide a refrigerator that facilitates access to each evaporator and improves maintenance performance.

Another objective of the present disclosure is to provide a refrigerator, which is equipped with a plurality of evaporators, having a structure in which different temperatures of cold air cooled in the different evaporators are brought into different cooling chambers without being mixed.

In accordance with an aspect of the present disclosure, a refrigerator includes a main refrigerator body including a cooling chamber, a machine room, and a partition wall interposed between the cooling chamber and the machine room; an evaporator contained in the machine room; and a cooling unit detachably mounted in the machine room and including a compressor, a condenser, and an insulation member, wherein the cooling unit, while mounted in the machine room, has the insulation member contact the partition wall to form an insulation space, and the evaporator is contained in the insulation space.

The refrigerator may include a plurality of evaporators, the insulation member may contact the partition wall to form a plurality of insulation spaces, and each of the plurality of insulation spaces may contain at least one of the plurality of evaporators.

The insulation member may be interposed between at least one of the compressor and the condenser and the evaporator.

The evaporator may be installed in the cooling unit, so that the evaporator is also taken out when the cooling unit is separated from the machine room.

The partition wall may include an insulation material.

The main refrigerator body may further include a plurality of cooling chambers and a plurality of ducts extending from the plurality of insulation spaces to the plurality of cooling chambers, and the plurality of ducts may be configured to guide cold air cooled by the plurality of evaporators to the plurality of cooling chambers.

The cooling chamber may be arranged in the front of the main refrigerator body, the machine room may be arranged behind the cooling chamber, and the evaporator may be arranged, while the cooling unit is mounted in the machine room, on one of front, top, or side of at least one of the condenser and the compressor with the insulation member located in between.

The refrigerator may include a plurality of evaporators, the cooling chamber may include a refrigeration chamber and a freezer chamber, an evaporator of the plurality of evaporators to cool cold air circulating in the refrigeration chamber may be arranged on the front or the top of at least one of the condenser and the compressor, and an evaporator of the plurality of evaporators to cool cold air circulating in the freezer chamber may be arranged on the side of at least one of the condenser and the compressor.

The cooling unit may further include a cooling fan, and the compressor may be arranged on a discharging side of the cooling fan.

The cooling unit may further include an electronic box containing electronic device components to control the refrigerator, the condenser may be arranged on a sucking side of the cooling fan, and the electronic box may be arranged downstream from the compressor in a wind blowing direction of the cooling fan.

The evaporator, the compressor, and the condenser installed in the cooling unit may be linked to one another by a refrigerant pipe to form a cooling circuit.

The partition wall may be detachably mounted on the main refrigerator body.

The partition wall may be detachable from the side of the cooling chamber.

The refrigerator may further include a wind blower configured to bring cold air into the cooling chamber, the partition wall may include an inflow hole to send cold air to the cooling unit and an outflow hole to send cold air to the cooling chamber from the cooling unit, and the wind blower may be installed in the outflow hole.

The cooling unit may further include a wind blower configured to bring cold air into the cooling chamber, and the insulation member may include a through hole receiving the wind blower.

In accordance with another aspect of the present disclosure, a refrigerator including a main refrigerator body including a cooling chamber; and a cooling unit detachably mounted in the main refrigerator body and including an evaporator, a compressor, a condenser, and an insulation member, wherein the cooling unit is arranged in a lower portion of the main refrigerator body, and the insulation member is interposed between at least one of the compressor and the condenser and the evaporator.

The cooling chamber may be arranged on a front side of the main refrigerator body, and the cooling unit may be arranged in a rear side of the main refrigerator body.

The cooling chamber may be arranged in the front of the main refrigerator body, the cooling unit may be mounted behind the cooling chamber, and the evaporator may be arranged, while the cooling unit is mounted in the main refrigerator body, on one of front, top, or side of at least one of the condenser and the compressor.

The insulation member may contact a wall forming the cooling chamber to form one or more insulation spaces.

The cooling unit may further include a cooling fan and an electronic box containing electronic device components to control the refrigerator.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
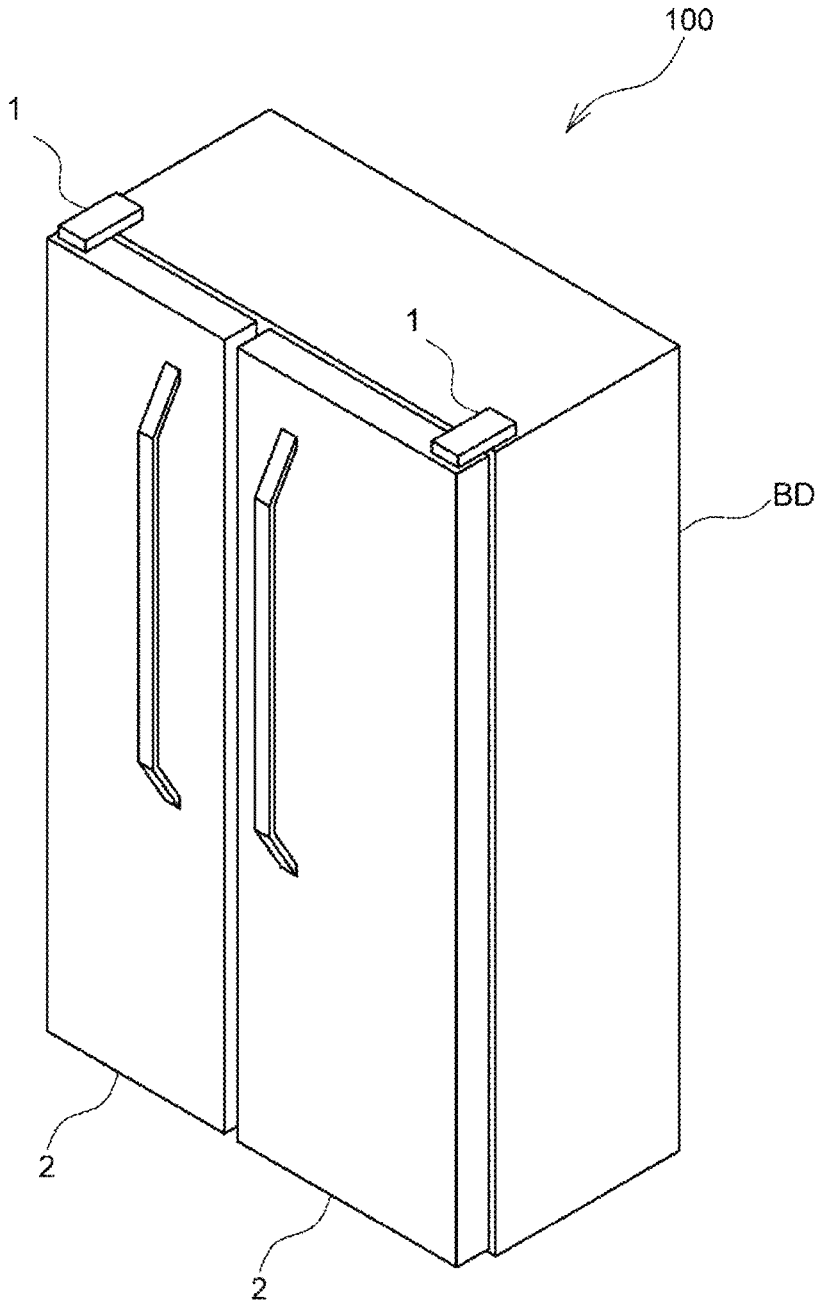
FIG. 1 illustrates a perspective view of a refrigerator, according to an embodiment of the present disclosure.

FIGS. 1 through 12B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined based on the drawings, but the terms may not restrict the shape and position of the respective components.

Reference will now be made in detail to embodiments, examples of which are illustrated in the accompanying drawings, wherein like reference numerals refer to the like elements throughout.

A refrigerator in the present disclosure is directed to one mainly used at home. It is not, however, limited to the refrigerator for home but may be equally applied to a refrigerator for business use. Furthermore, the refrigerator in the present disclosure includes not only one that is equipped with both freezer chamber and refrigeration chamber but also one that is equipped only one of the refrigeration chamber and the freezer chamber. Moreover, the refrigerator in the present disclosure may also be equipped with a temperature-controlled chamber for which the user may set a temperature, or equipped with three or more cooling chambers. The refrigerator in the present disclosure may have a form in which a plurality of cooling chambers are arranged in the left-right direction or in the up-down direction, or have a combinational form of the up-down arrangement and the left-right arrangement.

Referring to FIGS. 1 to 9, a refrigerator 100 in accordance with an embodiment of the present disclosure includes a rectangular main refrigerator body BD and a pair of doors 2 installed on the main refrigerator body BD through hinges 1 to be opened to the left or right, as shown in FIG. 1. In FIGS. 2, 3, and 6A to 8B, only the main refrigerator body BD is shown and the pair of doors 2 are omitted.

Figure 2:
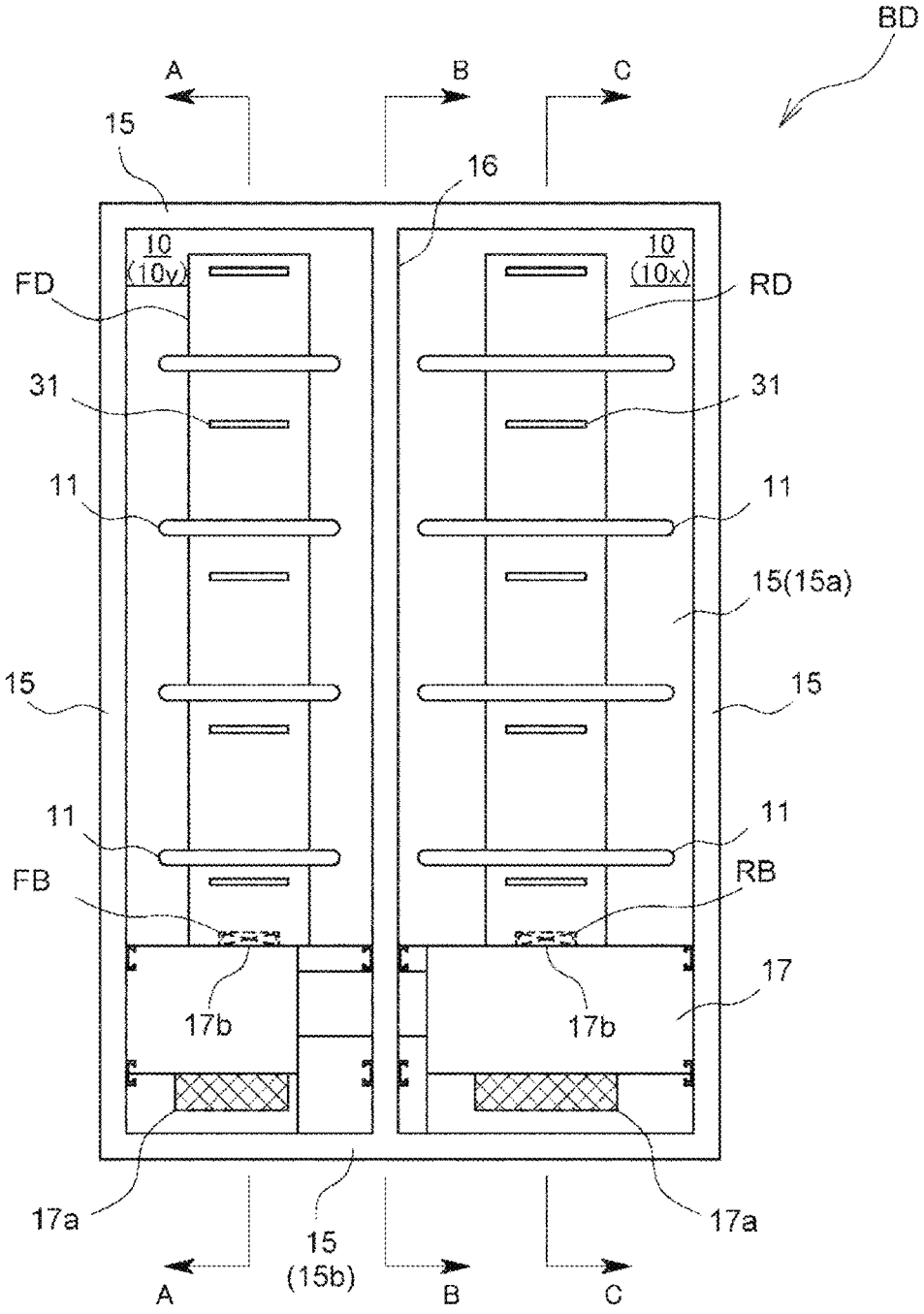
FIG. 2 is a schematic diagram illustrating a front view of a main body of a refrigerator with a cooling unit removed, according to an embodiment of the present disclosure.
Figure 3:
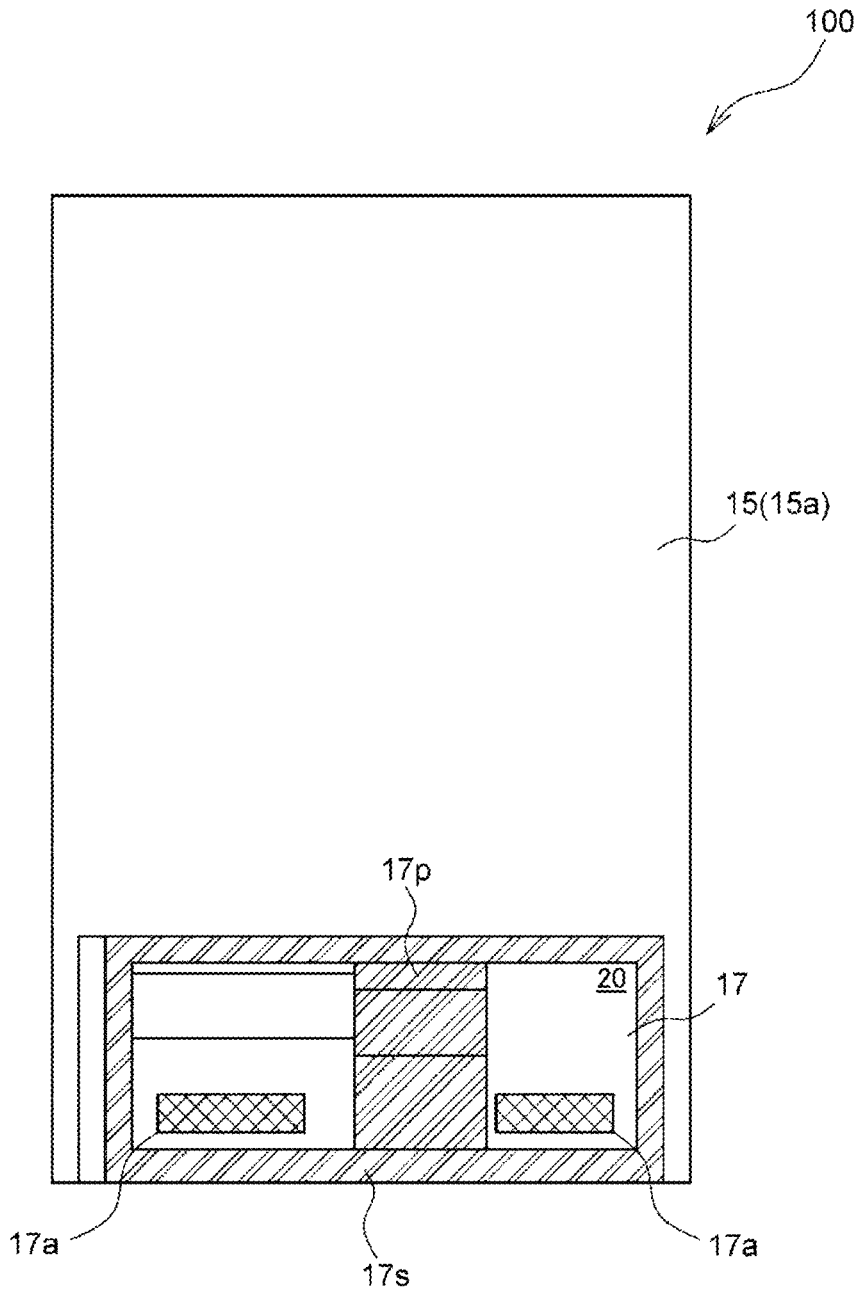
FIG. 3 is a schematic diagram illustrating a rear view of a main body of a refrigerator with a cooling unit removed, according to an embodiment of the present disclosure.

The main refrigerator body BD is opened to the front, as shown in FIG. 2, and includes two cooling chambers 10 closed by the pair of doors 2 and a machine room 20 opened to the back as shown in FIG. 3. There is a cooling unit CU detachably contained in the machine room 20. In other words, the cooling unit CU is removably mounted in the machine room. The machine room 20 is located in a lower portion of the main refrigerator body BD to be adjacent to the both cooling chambers 10 in the horizontal direction. Specifically, the machine room 20 is arranged to be adjacent to the rear side (inner side) of the both cooling chambers 10. In this regard, of the two cooling chambers 10, one cooling chamber 10*x* is used for refrigeration (hereinafter, referred to as "refrigeration chamber") and the other cooling chamber 10*y* is used for freezing (hereinafter, referred to as "freezer chamber").

The main refrigerator body BD has walls formed of an insulation material, which enclose the both cooling chambers 10. Specifically, the main refrigerator body BD has outer walls 15 enclosing the both cooling chambers 10, a first partition wall 16 interposed between the both cooling chambers 10, and a second partition wall 17 interposed between the both cooling chambers 10 and the machine room 20, the walls formed of an insulation material. Accordingly, the first partition wall 16 is an inner wall shared by the both cooling chambers 10, and the second partition wall 17 is an inner wall shared by the both cooling chambers 10 and the machine room 20. Furthermore, the second partition wall 17 corresponds to an inner wall of the machine room as recited in the accompanying claims.

The both cooling chambers 10 are identically configured except that the refrigeration chamber 10*x* has a larger storage capacity than the freezer chamber 10*y* as shown in FIGS. 2, 6A, 6B, 8A, and 8B. Specifically, the cooling chamber 10 has a plurality of shelves 11 installed on the upper side and a plurality of drawers (not shown) on the lower side. In the second partition wall 17, inflow holes 17*a* (represented in lattice patterns in FIG. 2) to send cold air to the cooling unit CU mounted in the machine room 20 from the cooling chamber 10 are formed on the lower side, and outflow holes 17*b* to send cold air to the cooling chamber 10 from the cooling unit CU mounted in the machine room 20 is formed on the upper side. Furthermore, in an outer wall 15*a* of the rear side of the cooling chamber 10, ducts RD, FD are installed to guide the cold air from the outflow holes 17*b* to the upward direction of the cooling chamber 10.

In the ducts RD, FD, wind inflow paths 31 are formed at positions corresponding to the respective shelves 11 and drawers. Furthermore, in the ducts RD, FD, wind blowers RB, FB are installed around inflow ports facing the outflow holes 17*b*. Moreover, the ducts RD, FD may include a damper for each wind inflow path 31 to adjust the opening degree of the wind inflow path 31. With this configuration, with each damper adjusting the opening degree of the wind inflow path 31, the flow rate of cold air sent to the cooling chamber 10 from each wind inflow path 31 may be controlled, and accordingly, each shelf 11 and drawer may be controlled to have an optimum temperature.

The machine room 20 is a space shaped like a triangular prism obtained by dividing a lower corner formed by the outer walls 15*a* and 15*b* on the rear side and on the bottom side of the main refrigerator body BD by the second partition wall 17. On an inner face directed to the rear side of the machine room 20, i.e., a face toward the machine room 20 of the second partition wall 17, a first osculation edge face 17*s* (represented by double oblique lines in FIG. 3) that tightly contacts the cooling unit CU at the edges is formed, and the inner side of the first osculation edge face 17*s* is embossed to fit the shape of the cooling unit CU. Furthermore, on the inner side of the first osculation edge face 17*s*, a first partition face 17*p* (represented by triple oblique lines in FIG. 3) that tightly contacts the cooling unit CU is formed to divide the inner side. The first partition face 17*p* is formed to run through the first partition wall 16, which is a border between an area of the refrigeration chamber 10*x* and an area of the freezer chamber 10*y*.

Figure 4:
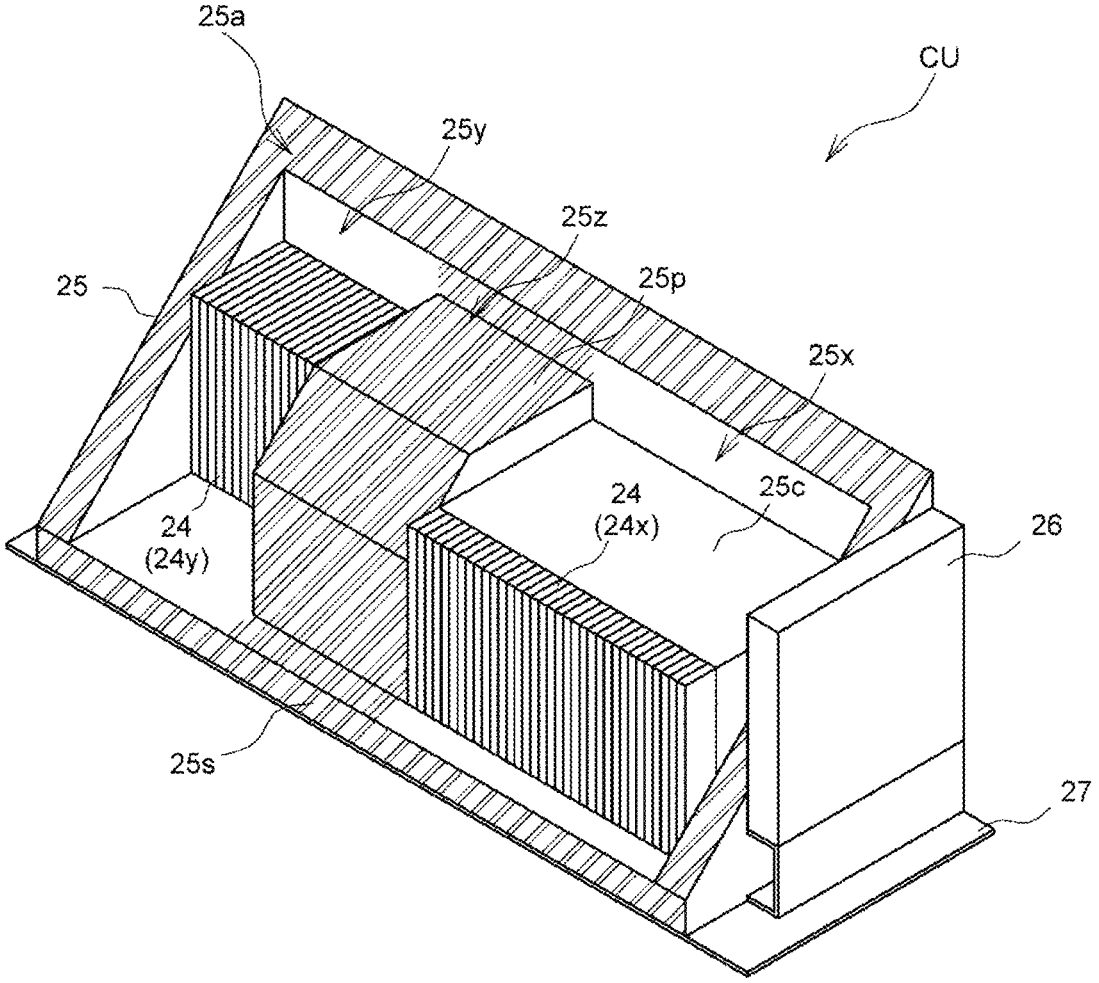
FIG. 4 is a schematic diagram illustrating a front view of a cooling unit, according to an embodiment of the present disclosure.
Figure 5:
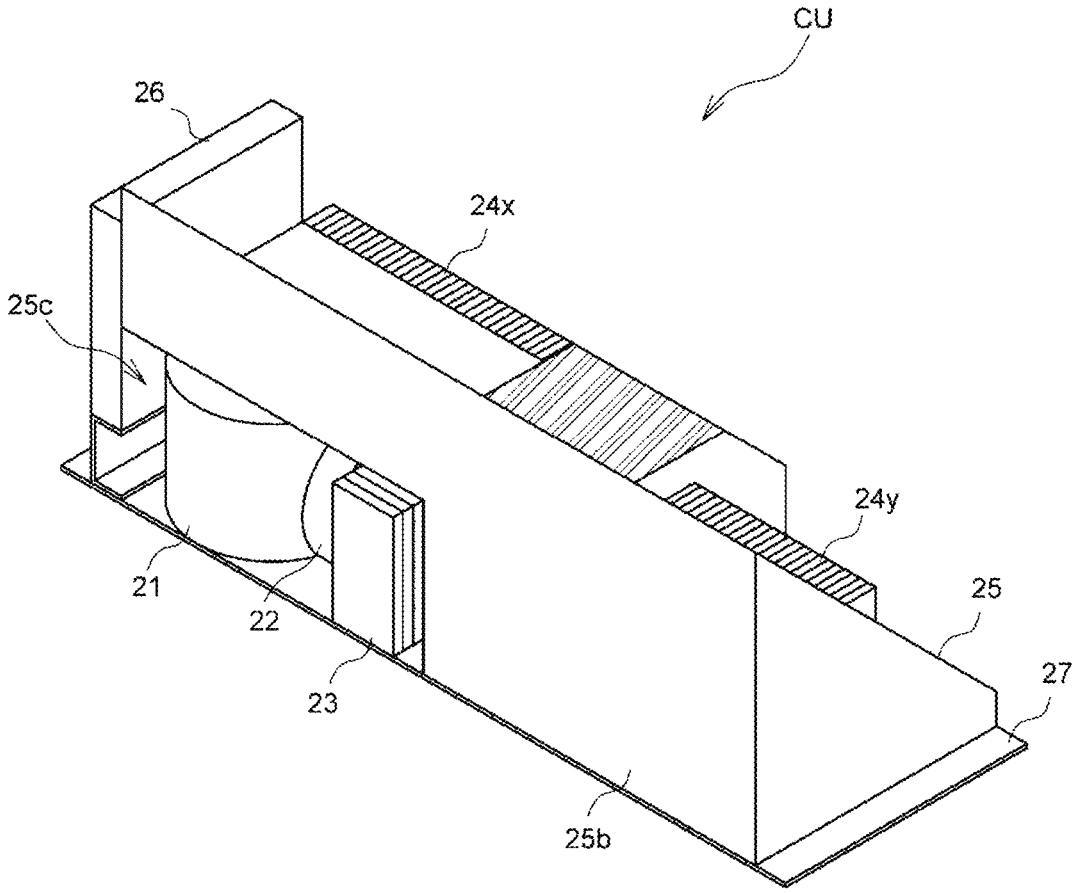
FIG. 5 is a schematic diagram illustrating a rear view of a cooling unit, according to an embodiment of the present disclosure.

The cooling unit CU includes a compressor 21, a cooling fan 22, a condenser 23, two evaporators 24, an insulation member 25, a control box 26 to control the devices, and a supporting plate 27 to support the enlisted elements, as shown in FIG. 4 or 5. When contained in the machine room 20, with the border being the same plane as the first partition wall 16, the cooling unit CU has the compressor 21, the cooling fan 22, the condenser 23 and an evaporator for refrigeration 24*x* installed in the area of the refrigeration chamber 10*x* and an evaporator for freezing 24*y* installed in the area of the freezer chamber 10*y*. The control box 26 is a so-called electronic box having electronic device components. In some embodiments, the control box 26 may have additional control functions other than the functions to control the aforementioned devices.

The insulation member 25 substantially has the form of a triangular prism that approximately matches the form of the space of the machine room 20. The insulation member 25 has a face (front face) opposite to the machine room 20, i.e., a face opposite to the second partition wall 17 be an oblique face 25*a* and a face (rear face), which is not opposite to the machine room 20, be a vertical face 25*b* that rises vertically. Accordingly, when contained in the machine room 20, the cooling unit CU is configured to have the oblique face 25*a* facing the second partition wall 17 and the vertical face 25*b* constituting a portion of the rear face of the main refrigerator body BD. Furthermore, on the oblique face 25*a*, a second osculation edge face 25*s* (represented by double oblique lines in FIG. 4) is formed to tightly contact the first osculation edge face 17*s* of the machine room 20 at the edges, and a second partition face 25*p* (represented by triple oblique lines in FIGS. 4 and 5) is formed to tightly contact the first partition face 17*p* to divide the inner side of the second osculation edge face 25*s*.

In the insulation member 25, a receiving space 25*c* for receiving the compressor 21, the cooling fan 22, and the condenser 23 is formed in the area of the refrigeration chamber 10*x* on the side of the vertical face 25*b*. The compressor 21, the cooling fan 22, and the condenser 23 are exposed to the rear side while contained in the receiving space 25*c*.

Moreover, in the insulation member 25, a partition 25*z* is installed to form the second partition face 25*p* on the side of the oblique face 25*a*. While the second osculation edge face 25*s* is in tight contact with the first osculation edge face 17*s* and the second partition face 25*p* is in tight contact with the first partition face 17*p*, a pair of concave spacers 25*x*, 25*y* are formed on either side of the partition 25*z* to make a room with the second partition wall 17. Of the pair of spacers 25*x*, 25*y*, one is the spacer for refrigeration 25*x* to be installed in the area of the refrigeration chamber 10*x* and the other is the spacer for freezing 25*y* to be installed in the area of the freezer chamber 10*y*. Since the spacer for refrigeration 25*x* is formed on the opposite side of the receiving space 25*c*, a protruding step is formed to secure the receiving space 25*c*.

The evaporator for refrigeration 24*x* has the form of a thin film and is installed in the spacer for refrigeration 25*x*. The evaporator for freezing 24*y* has the form of a rectangle and is installed in the spacer for freezing 25*y*.

The supporting plate 27 is made with a rectangular board. Although not shown, the board is reinforced by bending each side at a right angle not to be easily twisted.

The cooling unit CU is assembled as follows. First, on the supporting plate 27, the control box 26 is installed at one end, and the compressor 21, the cooling fan 22, and the condenser 23 are sequentially installed from the control box 26 toward the other end. Subsequently, on the supporting plate 27, the insulation member 25 is installed with the compressor 21, the cooling fan 22, and the condenser 23 contained in the receiving space 25*c* of the insulation member 25. In the spacer for refrigeration 25*x* of the insulation member 25, the evaporator for refrigeration 24*x* is installed, and in the spacer for freezing 25*y*, the evaporator for freezing 24*y* is installed. The cooling unit CU assembled as described above is in a state in which the insulation member 25 is interposed between the compressor 21, cooling fan 22 and condenser 23 and the evaporator for refrigeration 24*x* and evaporator for freezing 24*y*. Accordingly, the heat generated by the compressor 21 and the condenser 23 is hardly transmitted to each evaporator 24.

Furthermore, the compressor 21, the condenser 23, and the two evaporators 24*x*, 24*y* are linked by pipes 28 to circulate refrigerants. Specifically, a pipe 28*a* extending from the condenser 23 is branched by a switching expansion valve 29 into two to be linked to the evaporators 24*x*, 24*y*. Furthermore, a pipe 28*b* extending from the both evaporators 24*x*, 24*y* and joining in the way is linked to the compressor 21. The compressor 21 and the condenser 23 are linked by a pipe 28*c*. Accordingly, a cooling cycle (a cooling circuit) is formed. The pipes 28 pass through passage holes (not shown) for the pipes 28 formed in the insulation member 25, if necessary, to be linked to the devices. The switching expansion valve 29 may be a combination of a switching valve and an expansion valve such as a capillary, which may be replaced. In this regard, in the other drawings than FIG. 9, the pipes 28 and the switching expansion valve 29 are omitted.

Next, a state in which the cooling unit CU is contained in the machine room 20 will be described based on FIGS. 6A to 8B.

Figure 6A:
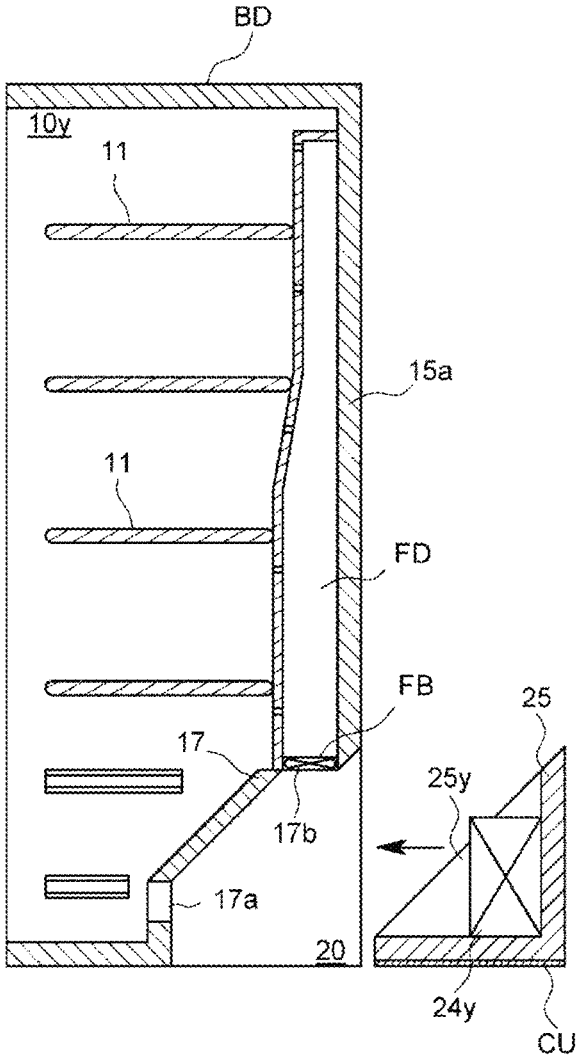
FIGS. 6A and 6B are A-A cross-sectional views illustrating states before and after a cooling unit is contained in the main body of a refrigerator, according to an embodiment of the present disclosure.
Figure 6B:
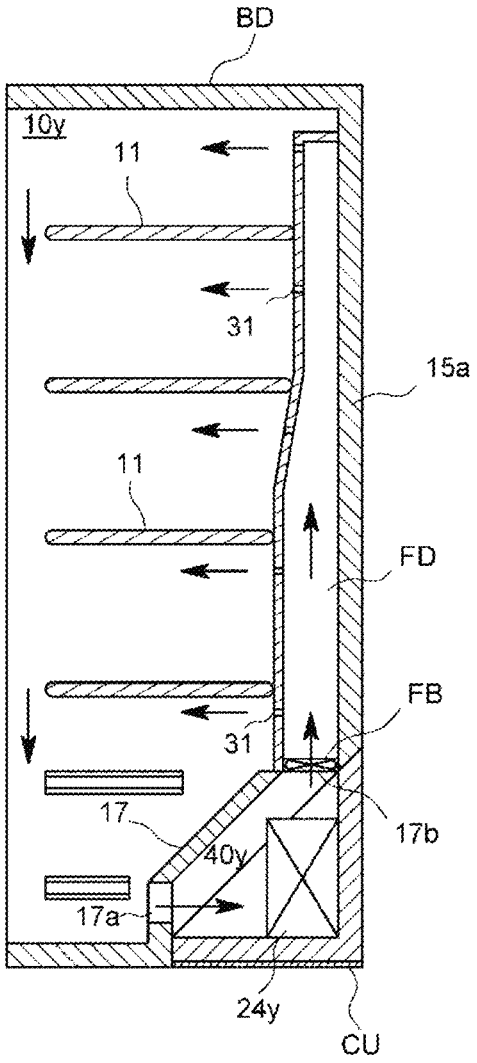
Figure 7A:
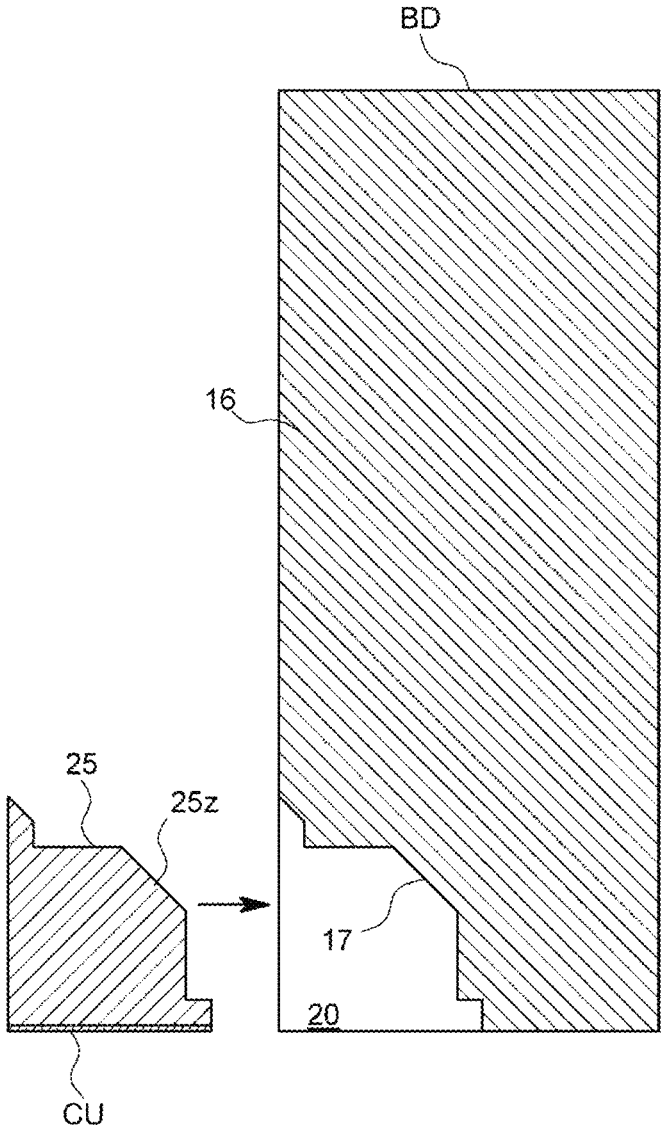
FIGS. 7A and 7B are B-B cross-sectional views illustrating states before and after a cooling unit is contained in the main body of a refrigerator, according to an embodiment of the present disclosure.
Figure 7B:
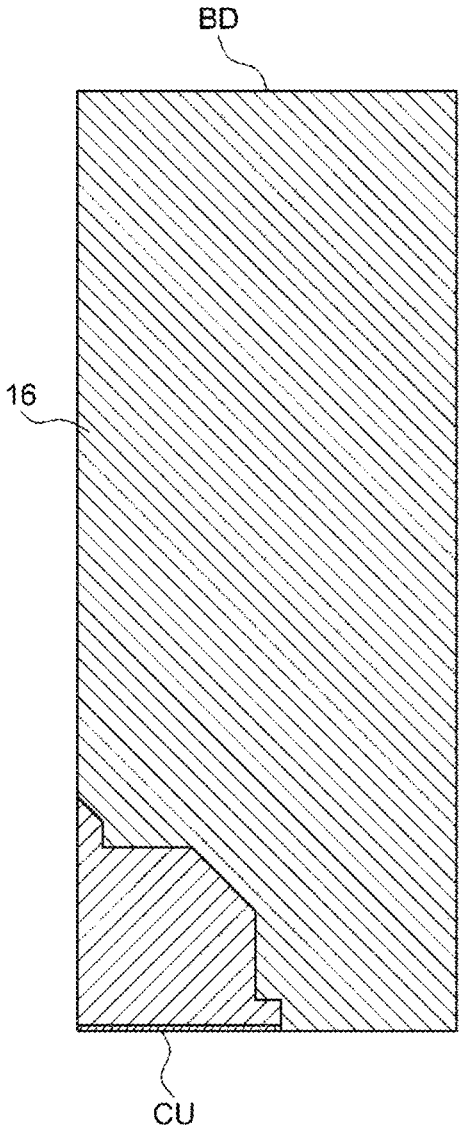
Figure 8A:
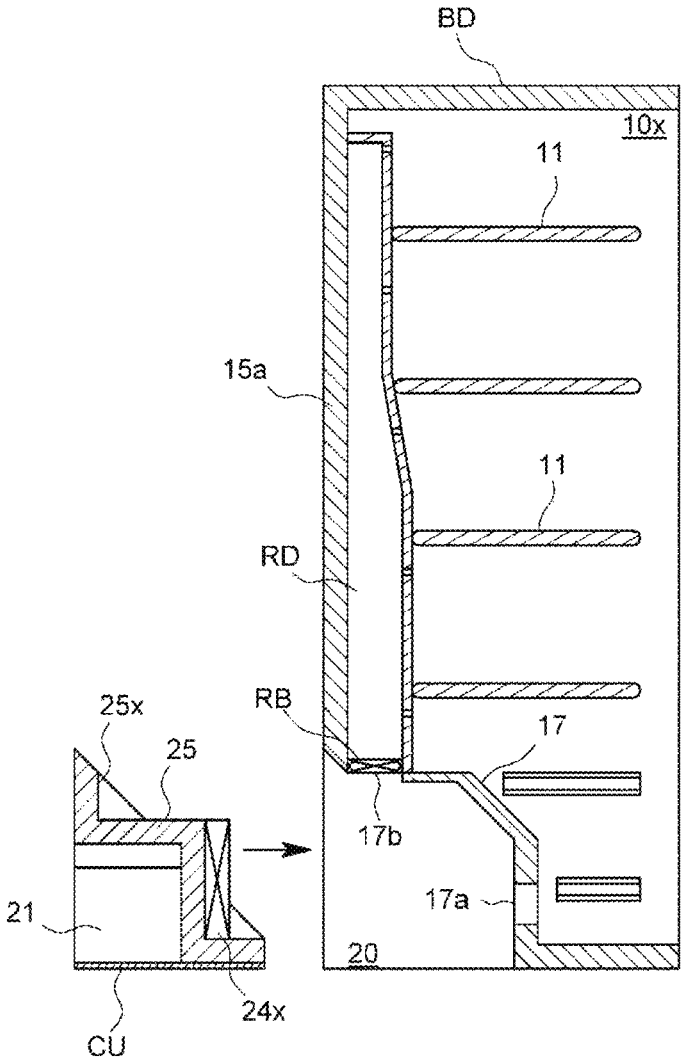
FIGS. 8A and 8B are C-C cross-sectional views illustrating states before and after a cooling unit is contained in the main body of a refrigerator, according to an embodiment of the present disclosure.
Figure 8B:
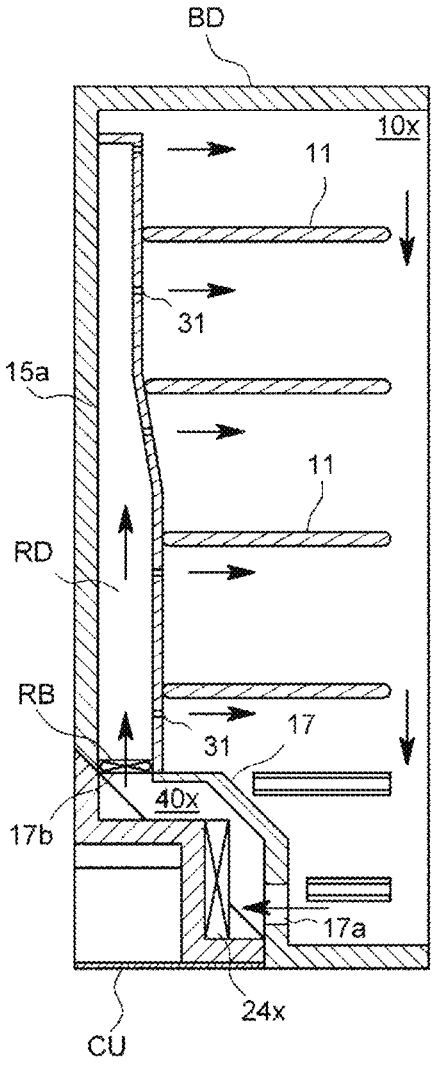
Figure 9:
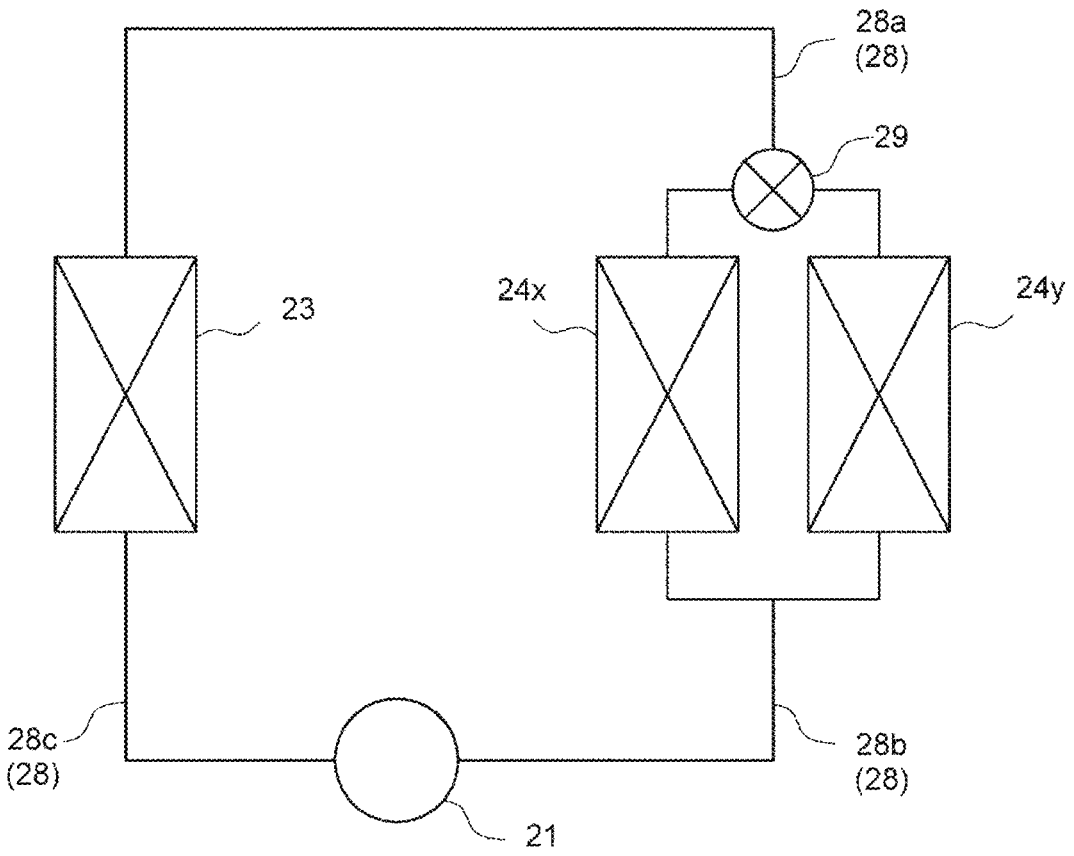
FIG. 9 is a schematic diagram illustrating a cooling cycle, according to an embodiment of the present disclosure.

Once the cooling unit CU is contained in the machine room 20, the second osculation edge face 25*s* of the insulation member 25 comes into tight contact with the first osculation edge face 17*s* of the second partition wall 17, and the second partition face 25*p* of the insulation member 25 comes into tight contact with the first partition face 170 of the second partition wall 17. Furthermore, in this state, as shown in FIGS. 8A and 8B, the spacer for refrigeration 25*x* of the insulation member 25 is separated from the second partition wall 17, forming an insulation space for refrigeration 40*x*, while as shown in FIGS. 6A and 6B, the spacer for freezing 25*y* of the insulation member 25 is separated from the second partition wall 17, forming an insulation space for freezing 40*y*.

For example, the first and second osculation edge faces 17*s* and 25*s* all have the form of a ring. The first partition face 17*p* is formed to define the first osculation edge face 17*s*, and the second partition face 25*p* is formed to define the second osculation edge face 25*s*. Accordingly, when the first and second osculation edge faces 17*s* and 25*s* come into tight contact with each other, the inside is divided by the partition 25*z* into the two insulation spaces 40*x*, 40*y*. With changes in number or shape of the partition 25*z*, the number of the insulation spaces 40 may be changed. Although concave parts are formed on the inner side of the first and second osculation edge faces 17*s* and 25*s* to form the insulation space 40 in this embodiment, a concave part may be formed on the inner side of only one of the first osculation edge face 17*s* and the second osculation edge face 25*s* to form the insulation space 40.

Furthermore, the insulation space for refrigeration 40*x* is interposed to link the inflow holes 17*a* and the outflow holes 17*b*, thereby forming cold air flow paths from the refrigeration chamber 10*x* to the duct RD. The insulation space for freezing 40*y* is interposed to link the inflow holes 17*a* and the outflow holes 17*b*, thereby forming cold air flow paths from the freezer chamber 106 to the duct FD.

The evaporator for refrigeration 24*x* installed in the insulation space for refrigeration 40*x* is installed between the compressor 21, cooling fan 22, and condenser 23 and the second partition wall 17 to face the inflow hole 17*a*. Accordingly, the cold air brought into the insulation space for refrigeration 40*x* from the refrigeration chamber 10*x* through the inflow hole 17*a* efficiently passes the evaporator for refrigeration 24*x*.

The evaporator for freezing 24*y* installed in the insulation space for freezing 40*y* is arranged along the second partition wall 17 in series with the compressor 21, the cooling fan 22, and the condenser 23 and located farthest from the compressor 21. This may make the evaporator for freezing 24*y* difficult to be influenced by the heat from the compressor 21 and thus able to cool the cold air at lower temperatures. The evaporator for freezing 24*y* is also arranged to face the inflow hole 17*a*, so that the cold air brought into the insulation space for freezing 40*y* from the freezer chamber 10*y* though the inflow hole 17*a* efficiently passes the evaporator for freezing 24*y*.

When the wind blowers RB, FB are activated, the cold air circulates through the ducts RD, FD, the cooling chamber 10, and the insulation space 40 (machine room) in sequence. Specifically, the cold air cooled by the evaporator for refrigeration 24*x* circulates in the refrigeration chamber 10*x*, and the cold air cooled by the evaporator for freezing 24*y* circulates in the freezer chamber 10*y*. Accordingly, the cold air cooled by each evaporator 24 circulates in each separate cooling chamber 10.

In accordance with the present disclosure, by removing the cooling unit from the machine room, whether the evaporator has an error may be checked, and by installing the cooling unit in the machine room, the evaporator may be contained in an insulation space. This facilitates access to the evaporator and noticeably improves maintenance performance.

It also makes it possible to have a structure in which a plurality of evaporators are contained in the respective separate insulation spaces, thereby preventing mixture of cold air cooled by the evaporators contained in the different insulation spaces. Accordingly, in a case of having a plurality of cooling chambers each having a different temperature range and a different humidity range, an evaporator corresponding to each cooling chamber may be controlled separately to circulate cold air in a proper temperature range and a proper humidity range for the cooling chamber. Furthermore, a plurality of evaporators each producing different temperature cold air may be cooled by a set of a compressor and a condenser, making the device installation space (machine room) compact, and as a result, a receiving capacity of the refrigerator may increase without increasing the outward form of the refrigerator.

Moreover, the insulation member interposed between the compressor or condenser and the evaporator makes it difficult to transmit the heat generated by the compressor or condenser to the evaporator, thereby improving the cooling efficiency.

Even while the cooling unit is removed from the main body of the refrigerator, each cooling chamber remains enclosed by the insulation material, preventing drastic increase in temperature of the cooling chamber.

Cold air cooled by an evaporator contained in each insulation space to have a different temperature range and a different humidity range may be guided to a cooling chamber with the same temperature range and the same humidity range, enabling more efficient cooling of the cooling chamber.

Since the evaporator for refrigeration, which is used to cool the refrigeration chamber having a higher temperature range than in the freezer chamber, is placed at a place with a narrow installation space, a wider installation space for the evaporator for freezing used for the low-temperature freezer chamber may be secured, making it easy to employ a larger evaporator for freezing having better cooling capability. In addition, contact areas between the evaporator for freezing and the compressor and condenser may be reduced and the distance between the evaporator for freezing and the compressor and condenser may increase. This makes it difficult to transmit heat generated by the compressor and condenser to the evaporator for freezing, which requires keeping as low a temperature as possible.

Figure 10:
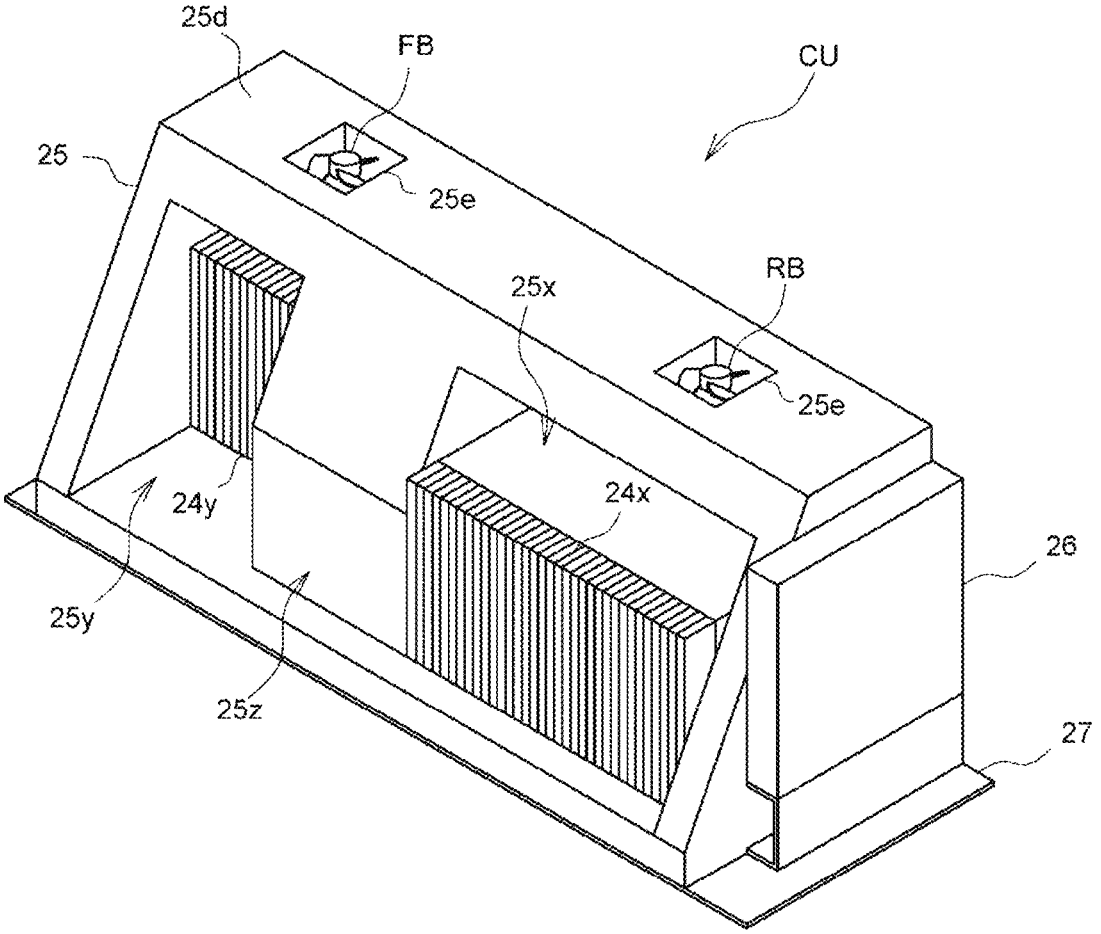
FIG. 10 is a schematic perspective view illustrating a cooling unit viewed from the front, according to another embodiment of the present disclosure.

In another embodiment of the present disclosure, the cooling unit CU includes the pair of wind blowers RB, FB, as shown in FIG. 10. The cooling unit CU in this embodiment has the insulation member 25 shaped like a box opened to the second partition wall 17, a pair of through holes 25*e* formed on a top wall 25*d* pushed up from the evaporators 24*x*, 24*y*, and the wind blowers RB, FB installed in between. Furthermore, in this embodiment, while the cooling unit CU is contained in the machine room 20, the opening of the insulation member 25 is blocked by the second partition wall 17, and thus, a pair of insulation spaces 40 are formed by the spacer for refrigeration 25*x* and the spacer for freezing 25*y*.

Accordingly, by removing the cooling unit CU from the main refrigerator body BD, the status of the wind blowers RB, FB may be easily checked and maintenance performance is further improved.

Although the refrigerator shown in FIGS. 1 to 8B has the evaporator 24 installed in the cooling unit CU, the evaporator 24 may be installed in the main refrigerator body BD. In the latter case, the cooling unit CU does not include the evaporator 24. Even in this case, while the cooling unit CU is contained in the machine room 20, the insulation space 40 is formed by the second partition wall 17 and the insulation member 25, and when the separate evaporators 24 are contained in the separate insulation spaces 40, mixture of the cold air cooled by the respective evaporators 24 may be prevented.

Although the refrigerator shown in FIGS. 1 to 8B takes a form in which the cooling unit CU is removed from the machine room 20 to access each of the evaporators 24, the second partition wall 17 may be detachable from e.g., the main refrigerator body BD to access each of the evaporators 24 from the side of the cooling chamber 10. In the latter structure, the refrigerator 100 is typically placed with its rear face against the wall, in which case, each of the evaporators 24 may be accessed without moving the refrigerator 100, thereby further improving maintenance performance.

Figure 11A:
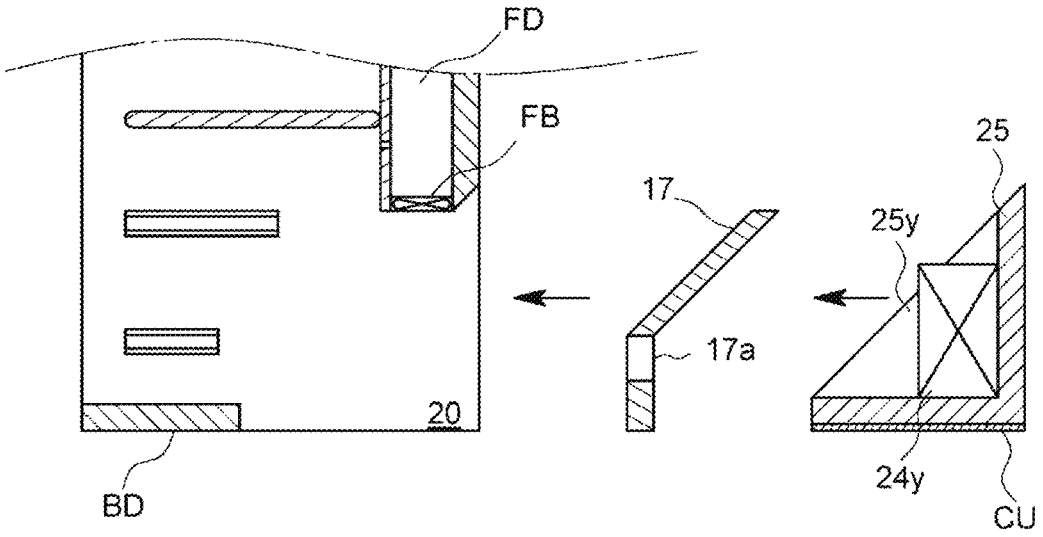
FIGS. 11A and 11B are cross-sectional views illustrating states before and after a cooling unit is contained in the main body of a refrigerator, according to another embodiment of the present disclosure.
Figure 11B:
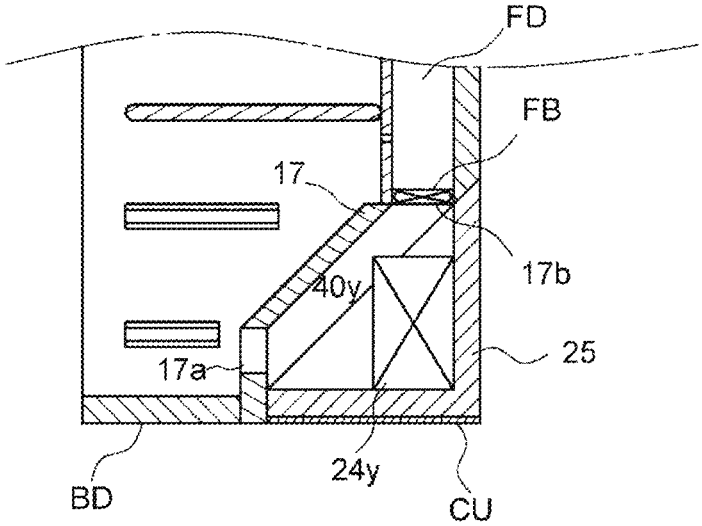
Figure 12A:
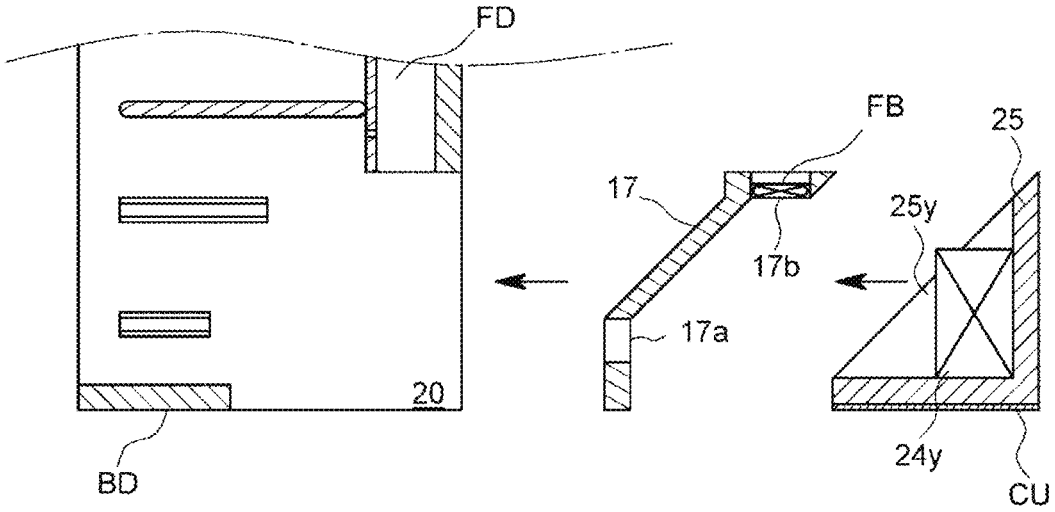
FIGS. 12A and 12B are cross-sectional views illustrating states before and after a cooling unit is contained in the main body of a refrigerator, according to another embodiment of the present disclosure.
Figure 12B:
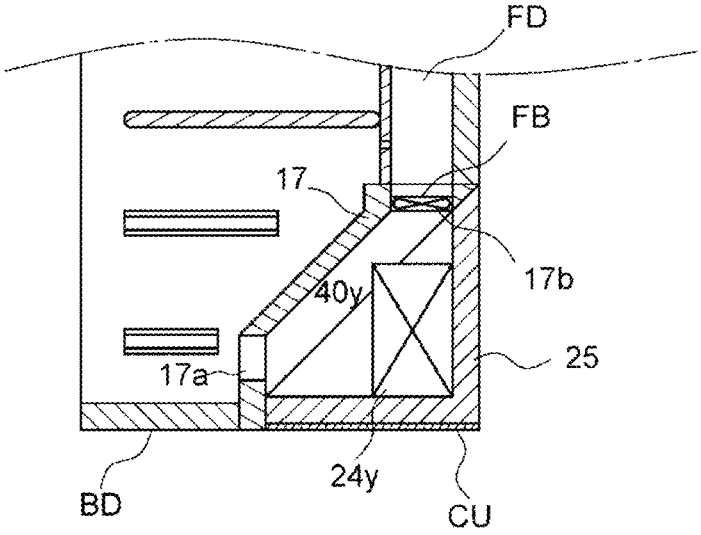

Furthermore, although the refrigerator shown in FIGS. 1 to 8B has the main refrigerator body BD in a structure in which the wall enclosing the cooling unit CU, i.e., the second partition wall 17 defining the machine room 20 is integrally formed with other wall defining the cooling chamber 10, it is not limited thereto. Specifically, for example, the main refrigerator body BD may have a structure in which the second partition wall 17 is detachable from another wall that defines the cooling chamber 10 as shown in FIGS. 11A and 11B, or a structure in which the second partition wall 17 and the outer wall 15*a* of the rear face are detachable from another wall defining the cooling chamber 10 as shown in FIGS. 12A and 12B. FIGS. 11A, 11B, 12A, and 12B show cross-sectional views of the freezer chamber 10*y* corresponding to FIGS. 6A and 6B. The main refrigerator body BD may also have a structure that enables all or part of the wall defining the machine room 20 including the second partition wall to be detachable from the wall defining the cooling chamber 10. In a case that the wind blowers RB, FB are installed in the outflow holes 17*b* formed in the second partition wall 17, removal of the second partition wall 17 from the main refrigerator body BD may make it easy to check the status of the wind blowers RB, FB and further improve maintenance performance.

Furthermore, although not shown, it would be good to have a structure in which the second partition wall 17 defining the machine room 20 is detachable from the side of the cooling chamber 10. In this case, it is easy to access each of the evaporators 24 from the side of the cooling chamber 10.

Although the refrigerator shown in FIGS. 1 to 8B has both the insulation spaces 40 completely separated by having the partition 25*z* of the insulation member 25 tightly and completely contact the second partition wall 17, even a small gap between the partition 25*z* and the second partition wall 17 may prevent a mixture of the cold air produced in both the insulation spaces 40. The present disclosure also includes this form.

Although the refrigerator shown in FIGS. 1 to 8B has the evaporators 24 arranged in the width direction of the refrigerator 100, the evaporators 24 may be arranged in the depth direction.

Although the refrigerator shown in FIGS. 1 to 8B has each insulation space 40 contain a single evaporator 24, multiple evaporators 24 may be contained in each insulation space 40. This may improve the cooling performance in each insulation space 40.

Although the refrigerator shown in FIGS. 1 to 8B has two cooling chambers installed in the main refrigerator body, only one cooling chamber or three or more cooling chambers may be installed therein. Although there are two insulation spaces formed, there may be three or more insulation spaces installed. In addition, although the refrigerator shown in FIGS. 1 to 8B has cooling chambers and insulation spaces installed in the same number, the number of the cooling chambers and the number of the insulation spaces may be different. In the latter case, for example, if there are more cooling chambers in number than the insulation spaces, cold air may circulate from a single insulation space to a plurality of cooling chambers, or otherwise if there are less cooling chambers in number than the insulation spaces, cold air may circulate from a plurality of insulation spaces to a single cooling chamber.

The scope of the present disclosure is not limited to the aforementioned embodiments. It will be understood by those skilled in the art that various changes in form and details may be made therein without departing from the spirit and scope of the disclosure as defined by the appended claims and their equivalents.

According to the present disclosure, access to each device, such as an evaporator becomes easy and maintenance performance is improved.

Furthermore, according to the present disclosure, in a refrigerator equipped with a plurality of evaporators, different temperatures of cold air cooled in the different evaporators are brought into different cooling chambers without being mixed.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a main refrigerator body including a cooling chamber, a machine room, and a partition wall interposed between the cooling chamber and the machine room;

an evaporator contained in the machine room; and a cooling unit detachably mounted in the machine room and including a compressor, a condenser, and an insulation member comprising a first face and a second face formed obliquely from the first face, wherein the partition wall includes an insulation material, and wherein, when the cooling unit is mounted in the machine room:

the first face of the insulation member and the second face of the insulation member directly contact the partition wall to form an insulation space, and the evaporator is contained in the insulation space.

2. The refrigerator of claim 1, wherein:

the refrigerator comprises a plurality of evaporators, the insulation member contacts the partition wall to form a plurality of insulation spaces, and each of the plurality of insulation spaces contains at least one of the plurality of evaporators.

3. The refrigerator of claim 2, wherein:

the main refrigerator body further comprises a plurality of cooling chambers and a plurality of ducts extending from the plurality of insulation spaces to the plurality of cooling chambers, and the plurality of ducts are configured to guide cold air cooled by the plurality of evaporators to the plurality of cooling chambers.

4. The refrigerator of claim 1, wherein the insulation member is interposed between the evaporator and at least one of the compressor or the condenser.

5. The refrigerator of claim 1, wherein the evaporator is installed in the cooling unit such that the evaporator is removed when the cooling unit is separated from the machine room.

6. The refrigerator of claim 5, wherein the evaporator, the compressor, and the condenser installed in the cooling unit are linked to one another by a refrigerant pipe to form a cooling circuit.

7. The refrigerator of claim 1, wherein:

the cooling chamber is arranged in front of the main refrigerator body, the machine room is arranged behind the cooling chamber, the evaporator is arranged, while the cooling unit is mounted in the machine room, on one of (i) a front of at least one of the condenser or the compressor, (ii) a top of at least one of the condenser or the compressor, or (iii) on a side of at least one of the condenser or the compressor, and the insulation member is located in between the evaporator and either the condenser or the compressor.

8. The refrigerator of claim 7, wherein:

the refrigerator comprises a plurality of evaporators, the cooling chamber comprises a refrigeration chamber and a freezer chamber, a first evaporator of the plurality of evaporators is configured to cool cold air circulating in the refrigeration chamber and is arranged on the front or the top of at least one of the condenser or the compressor, and a second evaporator of the plurality of evaporators is configured to cool cold air circulating in the freezer chamber and is arranged on the side of at least one of the condenser or the compressor.

9. The refrigerator of claim 1, wherein:

the cooling unit further comprises a cooling fan, and the compressor is arranged on a discharging side of the cooling fan.

10. The refrigerator of claim 9, wherein:

the cooling unit further comprises an electronic box containing electronic device components configured to control the refrigerator, the condenser is arranged on a sucking side of the cooling fan, and the electronic box is arranged downstream from the compressor in a wind blowing direction of the cooling fan.

11. The refrigerator of claim 1, wherein the partition wall is detachably mounted on the main refrigerator body.

12. The refrigerator of claim 1, wherein the partition wall is detachable from a side of the cooling chamber.

13. The refrigerator of claim 1, wherein:

the refrigerator further comprises a wind blower configured to bring cold air into the cooling chamber, the partition wall comprises an inflow hole to send cold air to the cooling unit and an outflow hole to send cold air to the cooling chamber from the cooling unit, and the wind blower is installed in the outflow hole.

14. The refrigerator of claim 1, wherein:

the cooling unit further comprises a wind blower configured to bring cold air into the cooling chamber, and the insulation member comprises a through hole receiving the wind blower.

15. A refrigerator comprising:

a main refrigerator body including a cooling chamber; and a cooling unit detachably mounted in the main refrigerator body and including an evaporator, a compressor, a condenser, and an insulation member comprising a first face and a second face formed obliquely from the first face, wherein:

a partition wall includes an insulation material, the cooling unit is arranged in a lower portion of the main refrigerator body, and the insulation member is interposed between the evaporator and at least one of the compressor or the condenser and the first face of the insulation member and the second face of the insulation member directly contact a wall of the cooling chamber to form an insulation space.

16. The refrigerator of claim 15, wherein:

the cooling chamber is arranged on a front side of the main refrigerator body, and the cooling unit is arranged in a rear side of the main refrigerator body.

17. The refrigerator of claim 15, wherein:

the cooling chamber is arranged in front of the main refrigerator body, the cooling unit is mounted behind the cooling chamber, and the evaporator is arranged, while the cooling unit is mounted in the main refrigerator body, on one of (i) a front of at least one of the condenser or the compressor, (ii) a top of at least one of the condenser or the compressor, or (iii) on a side of at least one of the condenser or the compressor.

18. The refrigerator of claim 15, wherein the insulation member contacts a wall, which forms the cooling chamber, to form one or more insulation spaces.

19. The refrigerator of claim 15, wherein the cooling unit further comprises a cooling fan and an electronic box containing electronic device components configured to control the refrigerator.

* * * * *